US006510303B2

(12) United States Patent
Bessette

(10) Patent No.: US 6,510,303 B2
(45) Date of Patent: Jan. 21, 2003

(54) EXTENDED-LIFE TONER CARTRIDGE FOR A LASER PRINTER

(75) Inventor: Lionel C. Bessette, N. Grafton, MA (US)

(73) Assignee: Clarity Imaging Technologies, Springfield, MA (US)

( * ) Notice: Subject to any disclaimer, the term of this patent is extended or adjusted under 35 U.S.C. 154(b) by 0 days.

(21) Appl. No.: 09/809,579

(22) Filed: Mar. 15, 2001

(65) Prior Publication Data

US 2002/0159795 A1 Oct. 31, 2002

(51) Int. Cl.[7] ..... G03G 15/08
(52) U.S. Cl. ..... 399/256; 399/53
(58) Field of Search ..... 399/263, 262, 399/258, 12, 27, 13, 24, 53, 256, 254; 222/644, 639, DIG. 1

(56) References Cited

U.S. PATENT DOCUMENTS 4,065,031 A * 12/1977 Wiggins et al. ..... 222/DIG. 1
5,634,169 A * 5/1997 Barry et al. ..... 399/12
5,942,067 A * 8/1999 Newman
5,995,772 A * 11/1999 Barry et al. ..... 399/12
6,009,285 A * 12/1999 Barry et al. ..... 399/27
6,169,860 B1 * 1/2001 Curry et al. ..... 399/12
6,295,422 B1 * 9/2001 Curry et al. ..... 399/12

OTHER PUBLICATIONS

"Cartridge Compenents", 1998, Static Control Components, Inc.

* cited by examiner

*Primary Examiner*—Susan S. Y. Lee
(74) *Attorney, Agent, or Firm*—Cesari and McKenna, LLP; William A. Loginov, Esq.

(57) ABSTRACT

An extended life-toner cartridge provides a set of required agitator paddle movement signals that fall within the expected parameters of the print engine controller—notwithstanding a higher toner level that would normally alter the paddle movement signals beyond acceptable timing ranges. The cartridge includes a toner tank agitator paddle assembly with a paddle movement reporting mechanism that particularly compensates for the larger volume of toner in the tank. In addition, the toner tank can include an enlarged tank extension for increasing reservoir capacity.

6 Claims, 9 Drawing Sheets

EXTENDED-LIFE TONER CARTRIDGE FOR A LASER PRINTER

BACKGROUND OF THE INVENTION

1. Field of the Invention

This invention relates to desktop electronic laser printers and more particularly to removable/replaceable toner cartridges for use with such laser printers.

2. Background Information

Laser printers use a focused light beam to expose discrete portions of an image transfer drum so that these portions attract printing toner. Toner is a mixture of pigment (typically carbon black) and plastic. The toner becomes electric statically attracted to exposed portions of the image transferred drum. As a transfer medium such as paper is passed over the rotating image transferred drum, some of the toner is laid onto the medium. Subsequently, the medium passes through a heated fuser so that the plastic is melted into permanent contact with the underlying medium.

The vast majority of desktop laser printers currently available utilize replaceable toner cartridges that incorporate an image transfer drum, a toner tank and a metering system and a drive mechanism for the drum and metering system. Modern toner cartridges often include a variety of sensors that interact with the laser printer in order to indicate the status of the cartridge. Indications relating to toner level, print quality and general cartridge function are often included. A large number of types and sizes of toner cartridges are currently available. Each cartridge is provided with its own set of operating perimeters and toner fill limitations. Certain cartridges, such as the Optra® S 4019/4039/4049 cartridge, available from Lexmark® utilize a complex sensing system for cartridge performance. The sensing system includes an encoder wheel interconnected with a rotating agitator blade within a cylindrical toner tank. Movement of the agitator blade feeds toner into the metering system. The encoder wheel reports the movement of the agitator wheel through the toner reservoir. The resulting signal must fall within certain perimeters, or a variety of error conditions are indicated by the printer, and print engine operation may suddenly cease.

The strict limits placed upon this cartridge, and others, can prove difficult to overcome for manufacturers seeking to provide a higher-capacity toner tank for compatible cartridges. This is because, manufactured and remanufactured cartridges must include no more than the original manufacture (OEM) toner level even if a higher level can be provided with appropriate performance. A higher level causes the agitator blade to move differently through the reservoir, thereby sending an erroneous signal to the printer.

Accordingly, it is an object of this invention to provide an extended life toner cartridge that enables a larger-capacity reservoir of toner to be utilized with cartridges having discreet, reduced, capacity limitations based upon internal sensors. This cartridge should enable an enlarged toner tank to be placed in the cartridge thereby extending the capacity of the overall toner reservoir.

SUMMARY OF THE INVENTION

This invention overcomes the disadvantages of the prior art by providing an extended life-toner cartridge that provides a set of required agitator paddle movement signals that fall within the expected parameters of the print engine controller—notwithstanding a higher toner level that would normally alter the paddle movement signals beyond acceptable timing ranges. The cartridge includes a toner tank agitator paddle assembly with a paddle movement reporting mechanism that particularly compensates for the larger volume of toner in the tank. In addition, the toner tank can include an enlarged tank extension for increasing reservoir capacity.

According to a preferred embodiment the agitator paddle assembly includes a timing gear assembly operatively connected to the print engine drive motor. The timing gear assembly includes a stop that enables the agitator paddle to become spring-loaded through a set amount of rotation until it engages a stop that limits further movement of the agitator blade with respect to the timing gear assembly. In a preferred embodiment the movement of the agitator paddle is limited to a greater extent than movement of the OEM agitator paddle. The agitator paddle assembly also includes an encoder wheel, rotationally fixed to the agitator paddle axle that generates a sensor signal equivalent to the encoder wheel of an OEM cartridge in the presence of a larger toner capacity.

According to the preferred embodiment, the encoder wheel includes a series of slots that pass through an optical sensor so as to generate time-variable pulses as the agitator paddle is rotated around the toner tank. The slots include multiple set of closely spaced slots, preceded by an elongated slot that are encountered as the paddle prepares to engage the toner supply. Also provided is a dwell area that is free of slots following the multiple slots. This area is encountered as the timing gear causes the paddle spring to wind until the stop drives the paddle into the toner supply. An additional set of slots then reports movement through the toner supply. The spring causes a snap-back motion of the paddle into the free space as it reaches the top of the toner supply near the cartridge developer section. In the preferred embodiment, the slots are offset and lengthened as appropriate to provide the desired expected timing sequence to the controller in the presence of a higher toner level that causes the paddle to engage the toner, and wind the spring earlier in the rotation cycle.

BRIEF DESCRIPTION OF THE DRAWINGS

The foregoing and other objects and advantages of this invention will become clearer with reference to the following detailed description as illustrated by the drawings in which.

DETAILED DESCRIPTION OF AN ILLUSTRATIVE EMBODIMENT

Figure 1:
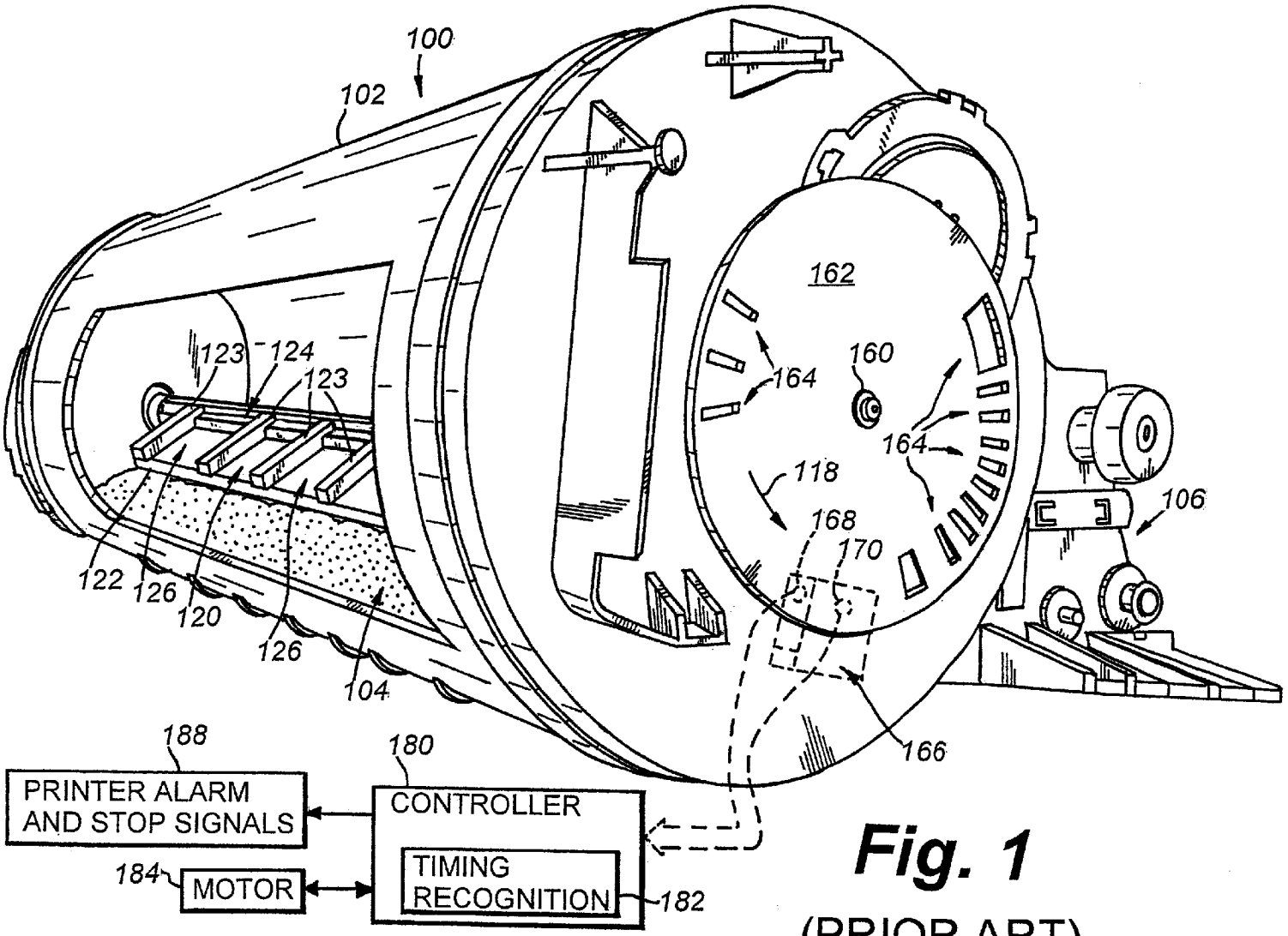
Fig. 1 (PRIOR ART)
FIG. 1 is an exposed perspective view of a toner cartridge toner tank assembly according to the prior art showing the encoder wheel side thereof.

An exemplary toner cartridge toner tank assembly 100 according to the prior art is shown in FIG. 1. As described above, the toner cartridge of this example can be an Optra® S 4059 cartridge, available from Lexmark®, and operating in a compatible print engine. This toner tank assembly includes the tank housing 102 that defines generally a cylindrical shape. Within the tank, along the bottom is located a toner supply 104 consisting of an electrostatically attracted particulate compound. In this example, the toner is a "one-part" toner having a color (carbon black for example) infused with a melting substance such as polystyrene plastic. Toner is deposited by a developer section 106 (refer briefly to FIG. 3 for details), having a supply roller 110, magnetic developer roller 112 and metering blade 114, onto an electrostatically charged image transfer drum 116. The drum 116 is charged in a particular pattern that corresponds to the pattern laid down by a coherent light source (e.g. a laser) L. The patterned toner is transferred from the drum 116 to a print media (paper for example) as it passes by the drum in synchronization with its rotation. The drum and other components of the cartridge are generally part of an overall outer cartridge housing that includes the tank assembly 100 and developer section 106 as well as certain sensors and control electronics.

The toner is continuously agitated and urged from the "sump" of the tank bottom to the developer section 106 by rotation (curved arrow 118) of an agitator paddle 120. The paddle is formed as a framework with a leading edge supported on a series of ribs 123 that are, in turn, connected to a central axle 124. The central axle is rotationally supported at the center of the tank cylinder. During paddle rotation, the leading edge 122 sweeps through an arc that passes just above the inner surface of the tank, while the ribs cut through the toner, enabling the toner to pass through interstices 126 defined therebetween. In this manner, the leading edge serves to break up and drive the toner upwardly into the developer section 106.

Figure 2:
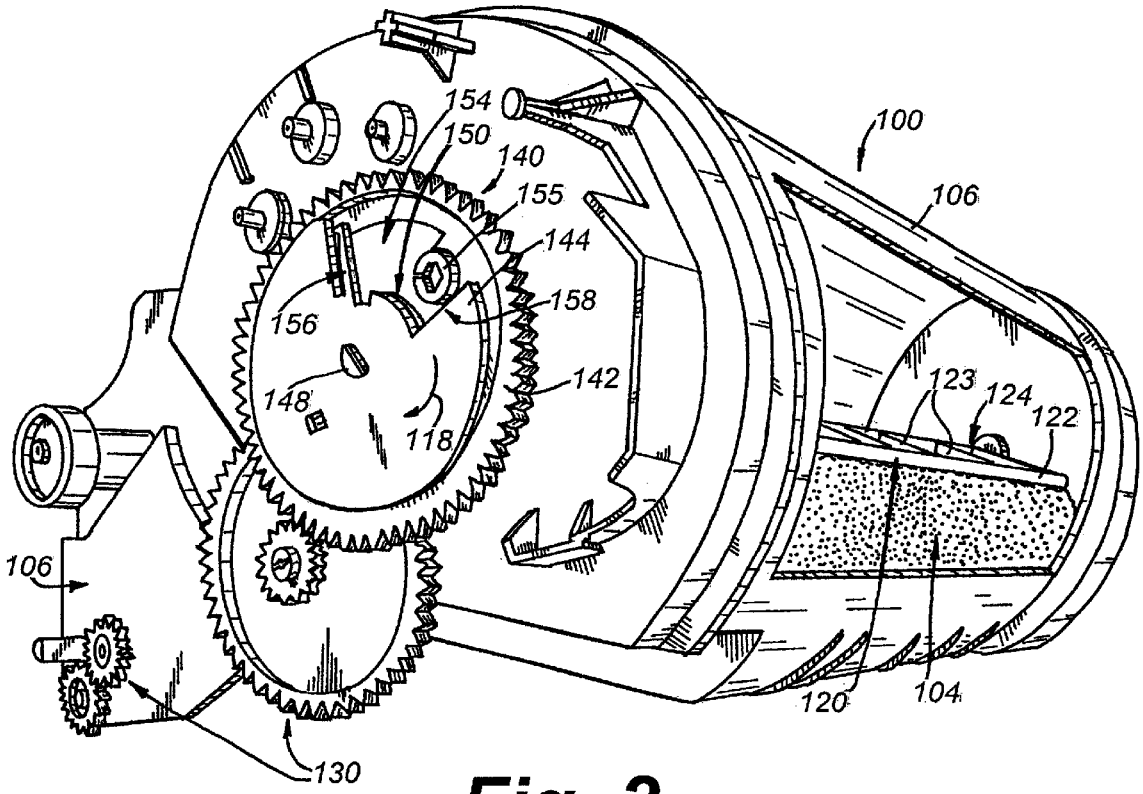
Fig. 2 (PRIOR ART)
FIG. 2 is an exposed perspective view of the toner cartridge toner tank assembly of FIG. 1 show a timing gear side thereof.

The developer section rollers and agitator paddle are driven by a printer engine drive motor (not shown) that engages a gear train 130 (FIG. 2). The agitator paddle 120 is particular drive by a timing gear assembly 140 having an outer driven gear 142, operatively interconnected with the print engine drive. The outer driven gear 142 is coaxial with an inner drive member 144. The inner drive member 144 is directly and fixedly (e.g. rotationally fixed) mounted to the end 148 of the agitator axle 124. Conversely, the outer driven gear 142 is rotationally freewheeling with respect to the axle 124. A wound coil spring 150 provides a torque between the outer driven gear 142 and the inner drive member 144. A wedge-shaped cutout 154 in the outer drive member 144 enables a stop 155 on the outer driven gear 142 to rotate within a predetermined range before engaging either of the cutout end walls 156, 158. The spring 150 normally biases the stop toward the end wall 156. As illustrated in FIG. 2, contact of the agitator paddle with the toner generates frictional resistance that tends to over-come the spring force, and causes the paddle to remain stationary while the spring 150 winds, eventually causing the stop 155 to engage the opposing cutout end wall 158 (as shown). At this point, the paddle is forced through the toner supply. The spring provides approximately 2–3 ounces of resistance to the paddle.

The winding spring function is part of a sensor scheme in the prior art commercially available toner cartridge. Referring to FIG. 1, the opposing end 160 of the paddle axle 124 includes a rotationally fixedly attached encoder wheel 162. The encoder wheel is a thin opaque (black plastic, for example) disk having a series of through-cut holes 164 defined about its perimeter. The holes 164 have varying arc lengths along the circumference of the disk and varying circumferential placement with respect to each other.

The holes 164 are adapted to pass through an optical sensor 166 (shown in phantom). The sensor is typically mounted on the print engine, and surrounds the perimeter area of the encoder wheel 162 when the cartridge is seated into the print engine. Alternatively, the sensor can be includes in the cartridge outer housing (not shown) and include contacts that communicate with the print engine. The sensor 166 consists of a light emitter 168 and a light receiver 170 each positioned on opposite sides of the wheel. The solid portions of the encoder wheel normally block transmission of light from the emitter to the sensor—but as holes 164 rotationally pass between the emitter and receiver, the sensor generates a time-variable pulse signal that is communicated to the print engine controller 180. Because the encoder wheel is fixedly mounted to the agitator paddle axle 124, the signals generated by encoder wheel movement provide a direct indication of the relative rotational position and movement speed of the paddle at various significant times within a print cycle. For the purposes of this description the encoder wheel and sensor shall be collectively termed as the paddle movement reporting mechanism, as they provide the controller with information regarding the state of the paddle as it moves through the tank.

The controller 180 can comprise any commercially available microcontroller, microprocessor or other control/logic unit, and is generally part of the overall print engine electronics package. The controller 180 includes a timing recognition functional block 182 that interprets the pulse signals generated by the sensor in terms of time duration, spacing between pulses and overall placement versus the print cycle. The controller can monitor and control the print engine motor 184 shown schematically and can generate a variety of alarm and motor/print stop signals 188 (and associated computer print status codes) if the timing is outside the controller's accepted predetermined parameters. For example, signals can trigger an alarm or stop is the toner agitator paddle becomes jammed, or alternatively, moves through the toner supply without substantial spring wind-up (or with delayed spring-wind-up—indicating a no-resistance/low-toner state). The various states of encoder wheel timing are discussed in further detail below.

Referring again to FIG. 3, an extended-life cartridge 200 according to a preferred embodiment of this invention is shown. The cartridge 200 includes a toner tank assembly 202 having a modified cylindrical toner tank housing 204. Components of the toner tank assembly 202 that are similar to those described above (FIGS. 1 and 2) have like reference numbers. By way of background, the toner supply 208 of an original equipment manufacturer toner cartridge (prior art) is normally limited to a maximum level indicated by the dashed line 210. The manner in which toner supply is limited is related directly to the expected output of time-variable pulse signals, which is in turn based upon rotation of the encoder wheel. Briefly, by increasing the toner level, the overall movement pattern of the agitator paddle (passing into, through and out of the toner supply) is changed, thereby changing the resulting signal pattern. In the toner cartridge according to the preferred embodiment, an increased toner level is desired, as shown by the exemplary line 212 is desired. In addition, a rearward extension 214 is preferably applied to the rear of the cartridge that extends beyond the normal cylinder wall 218 of the tank to further increase overall toner supply. The exact size and shape of the extension 214 can be widely varied. In general, it should be shaped so that toner passes relatively freely from the lower edge 220 of the extension into the main sump of the tank during agitation by the paddle using the force of the agitator paddle combined with gravity. The size and shape of the tank is typically limited by the overall shape of the outer cartridge housing and the internal geometry of the print engine (not shown) in which the cartridge housing is seated. For the purposes of this embodiment, a cross-sectional shape defining a partial oval or circle is chosen for the exemplary tank extension 214. It is also a substantially constant cross section across the entire length of the housing rear according to this embodiment. In one embodiment, the extension enables an additional 120–150 grams of toner to be loaded.

The extension 214 is optional. It is contemplated that a toner tank according to this invention may define its original cylindrical shape with increased toner level only. Alternatively, it is contemplated that the original equipment manufacturer's toner level (dashed line 210) can be maintained while the extension 214 is included to increase overall toner capacity without changing the level (note—there may still be a need to modify cartridge encoder wheel parameters according to this invention, as the changed amount may affect frictional resistance to agitator paddle movement). However, for purposes of this description both the overall toner level has been raised (line 212) and an extension 214 has been applied. Note that the extension also serves to favorably decrease resistance to paddle movement—which assists in enabling a higher initial toner level to be applied to the cartridge. The maximum toner level for the exemplary original equipment manufacturer's toner cartridge is 500 grams, while it is contemplated that approximately 1000 grams of toner can be held in the cartridge according to a preferred embodiment—a difference of 500 grams, or approximately twice the original capacity.

FIGS. 3–6 show the agitator paddle at different rotational positions within the toner tank, and are described generally below so as to provide an understanding of the movement of the agitator paddle through the toner supply. Briefly, rotation of the agitator paddle occurs in the direction of the arrow 118—driving the paddle so that it passes from is the rear of the cartridge, through the toner supply upwards toward the developer section 106 to continuously drive toner into the area of the developer roller 112, and then back through the free space above the toner supply.

Figure 3:
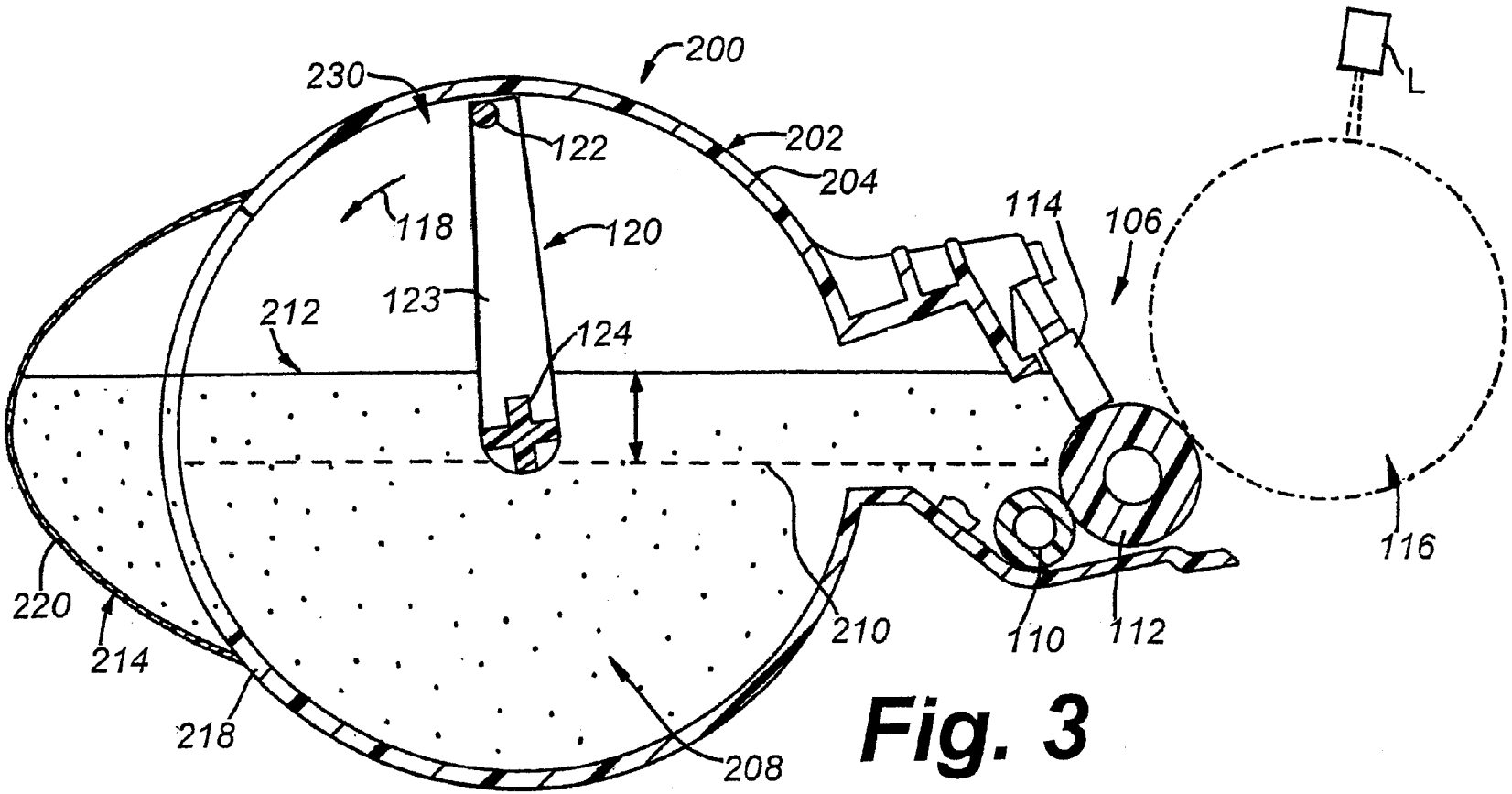
FIG. 3 is side cross section of the toner tank assembly an extended-life toner cartridge according to this invention in which the toner agitator paddle is in a position in the free space above the toner supply.

As shown generally In FIG. 3, the agitator paddle moves through free air space 230 in the tank 202 above the toner supply. In this position, the timing gear assembly stop has snapped against the cutout end wall 156 under force of the unwinding spring 150. After initial "snap-back" of the timing gear (toward end wall 156), movement of the agitator paddle through the free space occurs at a relatively constant speed.

Figure 4:
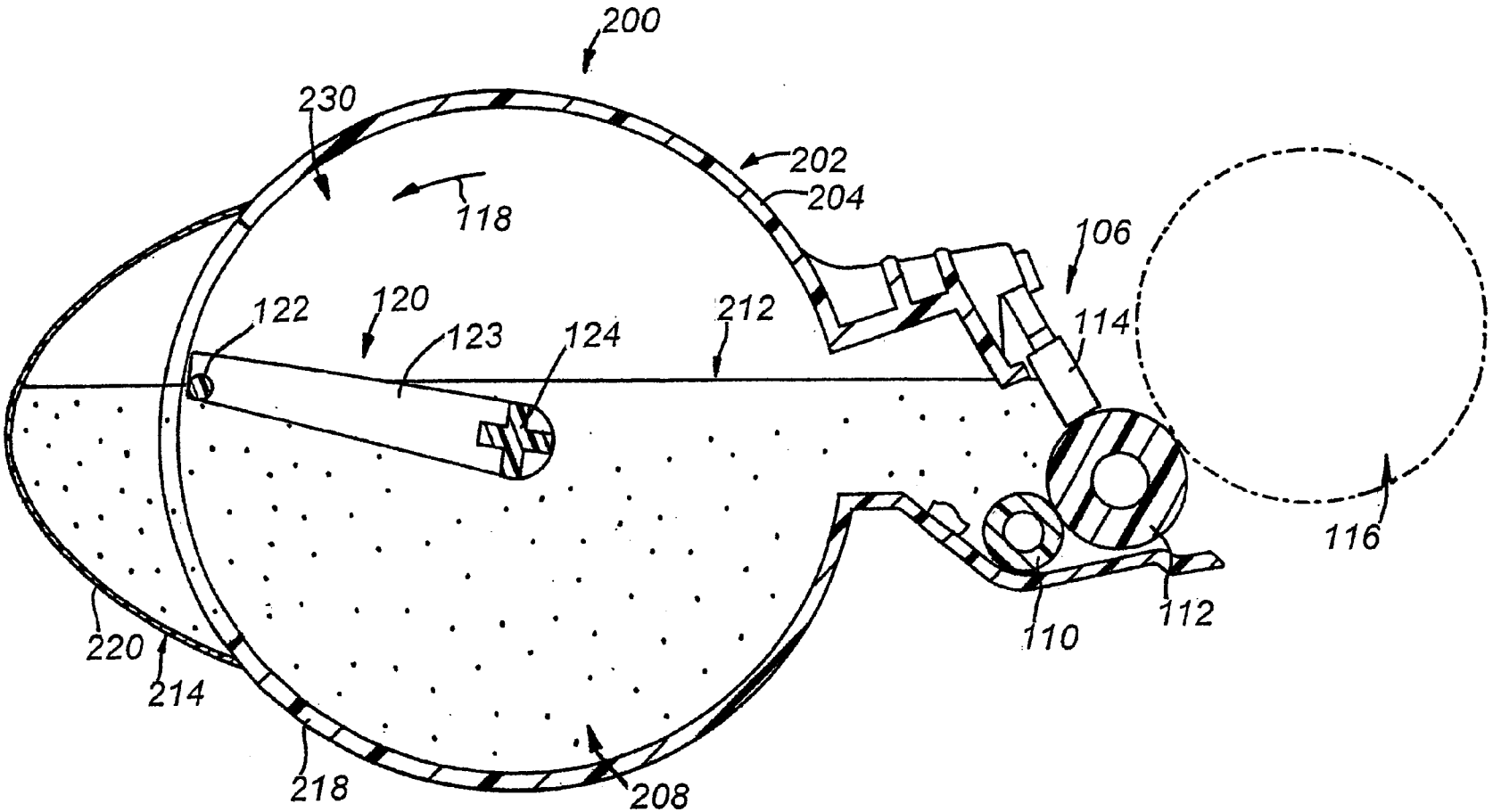
FIG. 4 is a side cross section of the toner tank assembly of FIG. 3 in which the agitator paddle is in a position of initial contact with the toner supply.

As shown in FIG. 4, the agitator paddle engages the rear area of the toner line 212. A certain amount of resistance is provided by the toner to movement into the supply by the agitator paddle. This causes a torsional "wind-up" action of the spring 150 in the timing gear assembly until the timing gear stop engages the cutout end wall 158 of the outer drive member 144.

Figure 5:
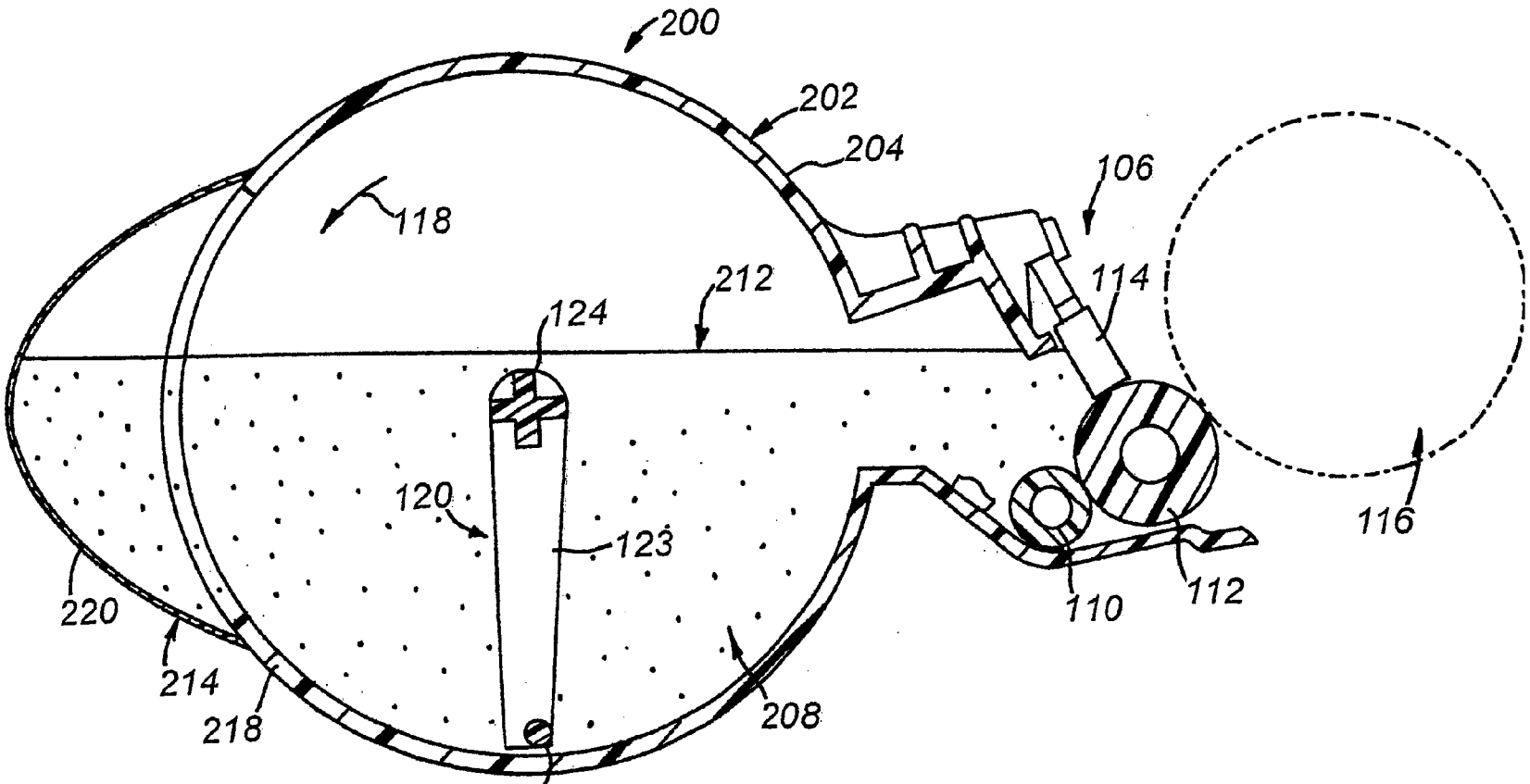
FIG. 5 is a side cross section of the toner tank assembly of FIG. 3 in which the agitator paddle is passing through the toner supply.

As shown in FIG. 5, the wound-up spring biases the agitator paddle through the toner supply with resistance applied by toner as the paddle passes therethrough so that the spring remains generally wound (with the timing gear stop biased against the end wall 158). It is contemplated that some degree of wavering movement may occur as resistance force on the paddle varies somewhat during its passage through the toner supply.

Figure 6:
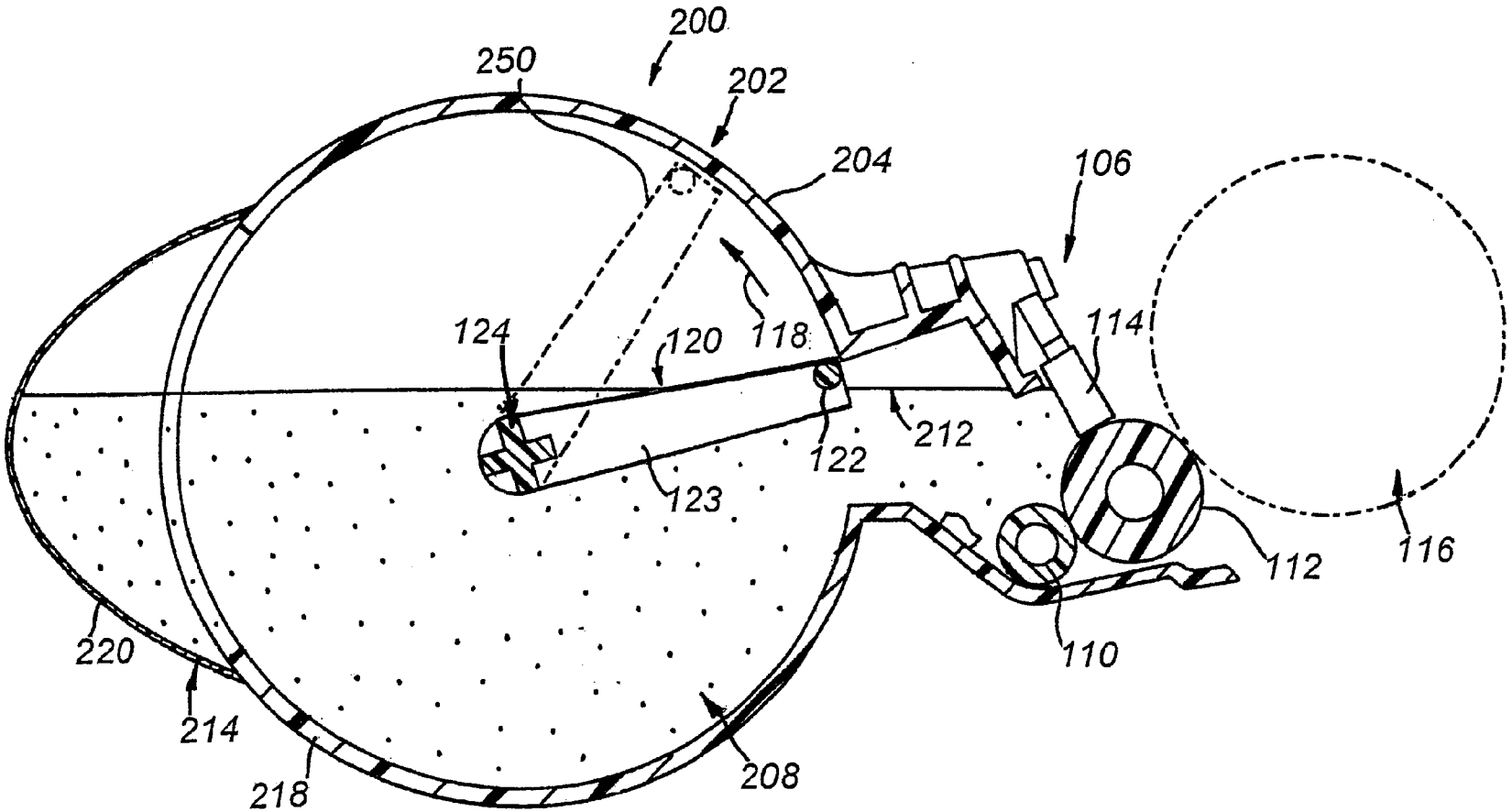
FIG. 6 is a side cross section of the toner tank assembly of FIG. 3 in which the paddle is in a position exiting the toner supply.

Finally, as shown in FIG. 6, the paddle nears the toner line 212, having driven toner upwardly and into the developer section 106. As the resistance supplied by the weight of the toner falls, near the toner line 212, the agitator paddle begins moving out of the toner supply (arrow 118) at a relatively high speed under the force of the spring (which is now sufficient to overcome the weight of the remaining toner. This is the above-described snap-back motion of the paddle toward the free space above the toner supply. The paddle thus moves rapidly to a fully snapped-back position 250 (shown in phantom) within the free space. From the snapped back position position, paddle movement repeats as shown in FIGS. 3–6—now with slightly less toner in the supply (and therefore, a slightly lower toner line) than the previous print cycle, resulting from the transfer of toner to the developer roll section 106 and image transfer drum.

Figure 7:
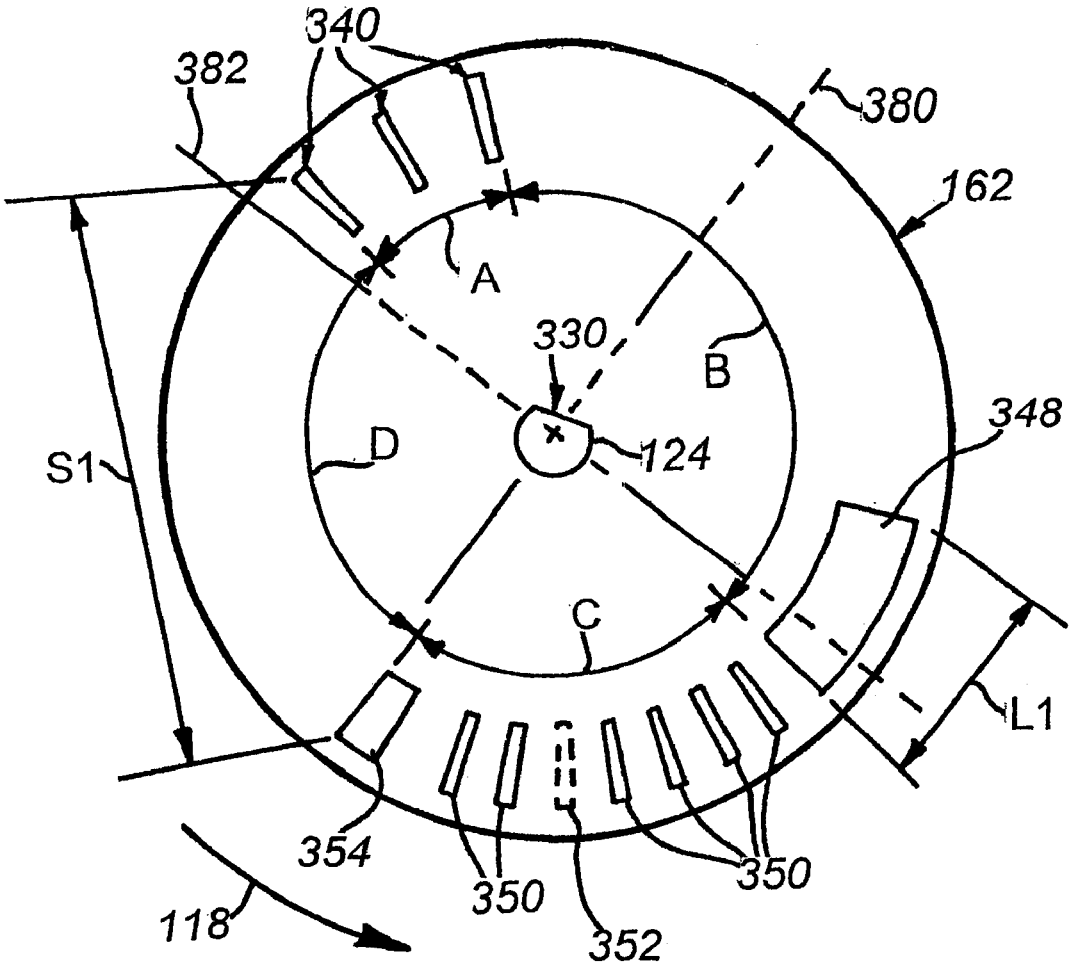
Fig. 7 (PRIOR ART)
FIG. 7 is plan view of the encoder wheel for a toner cartridge according to the prior art.
Figure 8:
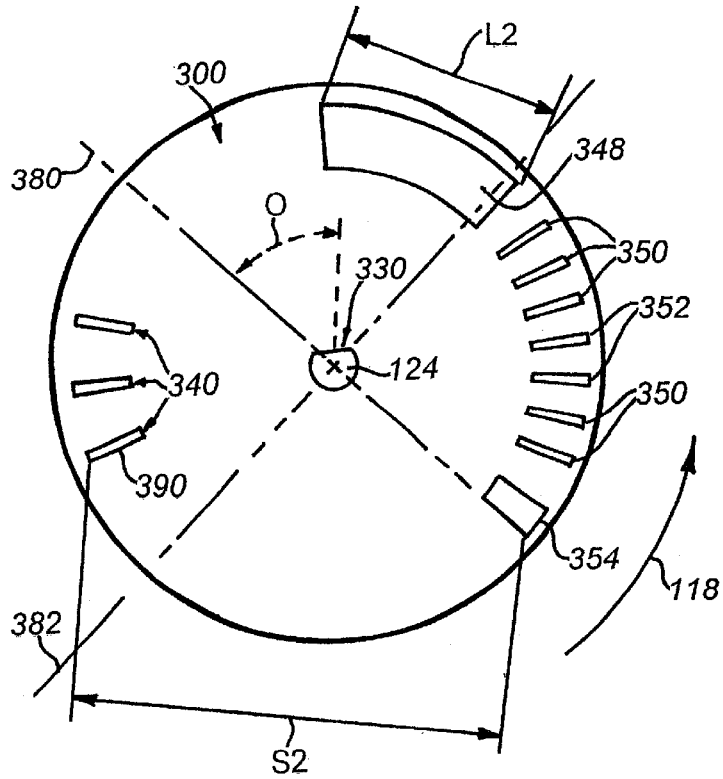
FIG. 8 is a plan view of the encoder wheel for an extended-life toner cartridge according to this invention.

Reference is now made to FIGS. 7 and 8, which respectively show an original equipment encoder wheel 162 as described generally above (FIG. 7) and an extended-life toner cartridge encoder wheel 300 according to a preferred embodiment of this invention (FIG. 8). Also shown is an extended-life timing gear assembly 310. In addition, reference is made to the exemplary print engine controller timing diagram 320 shown in FIG. 10, which is used by the original equipment controller to regulate print engine functions.

According to the preferred embodiment, the cartridge of this invention, though modified for extended-life, should operate in accordance with the original equipment, or another predetermined standard timing specification. In other words, the extended-life toner cartridge of this invention should operate within the timing specifications and other control parameters meant for a conventional original equipment manufacturer's toner cartridge. As such, either the extended-life toner cartridge of this invention or the original manufacturer toner cartridge should be able to operate interchangeably in the desired print engine without requiring any change of internal timing specifications or control parameters on the print engine.

Figure 10:
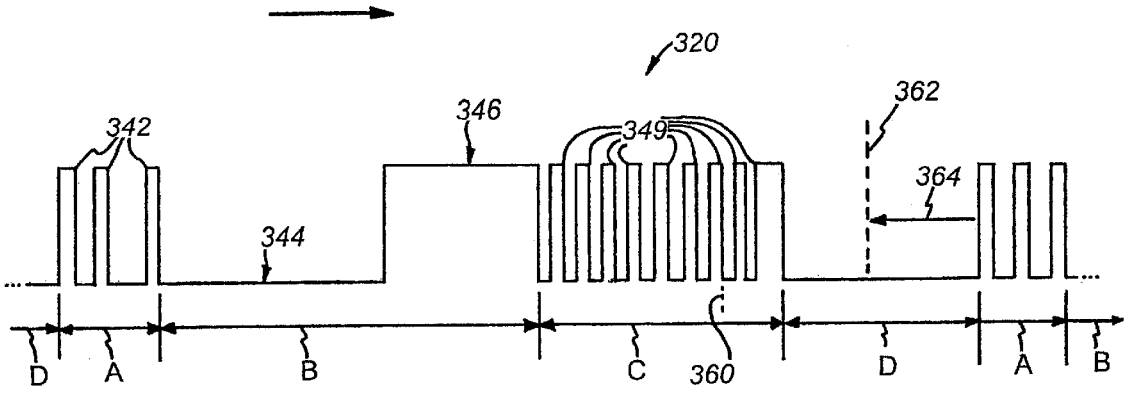
FIG. 10 is an exemplary timing diagram for encoder wheel pulses recognized by the printer controller.

Each encoder wheel 162 and 300 has a predetermined fixed rotational orientation with respect to the agitator axle 124. The axle includes a flat 330 that fixes the relative rotational position of the respective wheel 162, 300 relative to the axle and, hence, to the agitator paddle. Referring first to the original equipment manufacturer encoder wheel 162, at least four distinct timing sections A, B, C and D can be denoted about the circumference of the wheel. Section A consists of three evenly spaced holes 340. These holes 340 generate the corresponding time-variable pulse peaks 342 in the timing diagram (FIG. 10). These pulses occur at the time period in which the agitator paddle is fully engaged within the toner (FIG. 4). These signals must start, and occur within a certain time period, in the overall print cycle. They must also occur at a certain frequency, or an alarm signal (either too much or too little toner) is generated. In general, the pulses of section A enable the controller, via an appropriate look-up table to determine the toner level, and how many print cycles (pages) remain.

Next, the snap-back section B is presented, this consists of an "off" portion 344 of the timing signal and an "on" portion 346 of the timing signal (FIG. 10). The on portion is encountered when the elongated slot 348 is presented to the sensor. The off portion occurs prior to the paddle snap-back, and the on portion occurs during snap-back. Section B corresponds generally to the movement in FIG. 6.

Next, multiple-pulse section C is presented to the sensor. This is a series of eight short, regular pulses 349. These pulses correspond to the evenly spaced holes 350, 352 and 354. They are in part used to identify the type of toner cartridge present to the print engine controller. The fifth hole 352 in the series is shown in phantom because it is optional. This hole is present for larger-capacity OEM cartridges (though still smaller than the maximum capacity of the extended-life cartridge according to this invention). Therefore, the hole 352 is possibly omitted in the original equipment manufacture's cartridge. According to the preferred embodiment, all eight slots/pulses are provided. The final slot 354 in the series is slightly longer indicating the end of the pulse stream. Pulse section C is encountered as the paddle moves in free space toward the toner line. The controller is programmed to expect the toner line to be encountered (winding to begin) just after the final slot 354 passes through the sensor. Thereafter the dwell section D occurs with no pulse as winding proceeds and the paddle/encoder wheel is largely stationary until the timing gear assembly is sufficiently wound. Then, the paddle proceeds through the toner with a wound spring generating the three pulses of section A.

The ending of section C and beginning of section A indicate the general level of toner in the supply and govern (via the controller) whether the printer can operate. For example, if the toner level is greater than the maximum specified level, then the paddle contacts the toner line before the final slot 354 passes through the sensor. As such, the pulse stream may be interrupted at (for example) location 360 in the timing diagram. This causes the controller to issue an alarm and stop the printer.

Conversely, if the toner level is too low, very little or no wind-up of the spring may occur. As such, the dwell time D is reduced (i.e. no stoppage in encoder wheel movement), and the start of section A is moved to exemplary location 362 in the timing diagram. If the dwell time D is reduced sufficiently, it causes the printer to stop based upon a low toner alarm.

Accordingly, the increase in toner level in the cartridge of this invention should generate a set of pulses that fall within the expected time locations outlined above. Since increasing the toner level causes the eight-pulse section C to end prematurely, and thereby offsets the dwell section D, changes to the timing gear and encoder wheel are made.

FIG. 8 shows the encoder wheel 300 according to the preferred embodiment of this invention. In general, the alignment of the multiple slots 350, 352 and 354 about the perimeter has been moved counter to the rotation direction (arrow 118) by an offset O of approximately 40 degrees. This may be seen in the rotational shift in axis lines 380 and 382 with respect to the axle flat 330 (the paddle position being unchanged with respect to the flat in each of FIGS. 7 and 8). By rotating the multiple slots by 40 degrees, the slots now reach a higher toner level at the controller's expected time. The slots 340, 350, 352 and 354 are otherwise unchanged in size and spacing about the circumference. The initial slot 348 of the multiple slots has been lengthened from a length L1 of ⅝ inch (FIG. 7) to a length L2 of ⅞ inch to accommodate a shorter snap-back (described below).

In addition, the overall dwell distance D between the final slot 354 and initial section A slot 390 has been lengthened from a (outer corner-to-outer corner) linear distance L1 of ¼ inches (FIG. 7) to a distance L2 of 2 inches (FIG. 8). This essentially compensates for the shorter wind-up of the spring and longer time for the paddles to pass through the toner prior to snap-back.

Figure 9:
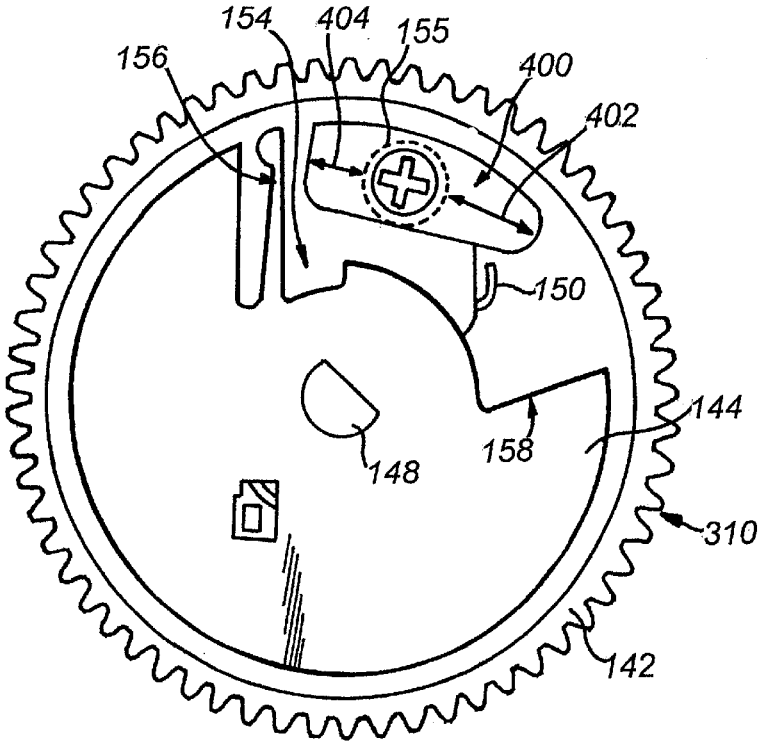
FIG. 9 is a plan view of a timing gear assembly for the extended-life toner cartridge according to this invention.

With further reference to FIG. 9, the snap-back and wind-up distance has been shortened to account for a higher maximum toner level (e.g. less paddle travel distance through the free space). The OEM stop 155 (shown in phantom) has been replaced with an elongated stop 400 that reduces the wind-up/snap-back travel by approximately one-half the original value. The spacer 400 extends approximately the same distance toward both the cutout end walls 156 and 158. The increased spacer distance 402 toward the end wall 158 can be slightly greater that the distance 404 toward the end wall 156 in a preferred embodiment. The exact reduction in snap back and distribution depend upon the general controller timing specification and threshold values.

By providing the encoder wheel defined in FIG. 8 and the accompanying timing gear assembly of FIG. 9, the cartridge sensor is presented with an output that falls within the expected timing parameters of FIG. 10, thereby enabling the cartridge to operate with a higher initial toner level. Referring also to FIG. 10, the following is a chart of observed timing values (in seconds) comparing an OEM cartridge to the extended-life (EL) cartridge according to the preferred embodiment for each timing section A–D:

| | A | B | C | D |
|---|---|---|---|---|
| OEM (Full) | 1.08 | 1.32 | 2.56 | 5.56 |
| EL (Full) | 1.20 | 3.60 | 2.88 | 4.30 |
| OEM (Empty) | 1.20 | 3.72 | 2.52 | 3.20 |
| EL (Empty) | 1.28 | 4.16 | 2.32 | 3.80 |

The above-described timing ranges are sufficient for normal operation of both the OEM and subject extended-life cartridges within the same unmodified print engine throughout a full range of toner levels from full to empty.

The foregoing has been a detailed description of a preferred embodiment of the invention. Various modifications and additions can be made without departing from the spirit and scope of this description. For example, the particular slot arrangement of the toner cartridge can be varied depending upon the desired timing signals and sequence required by the print engine. In addition, while an encoder wheel and sensor are used to deliver timing information with respect to the agitator paddle, an alternate paddle movement reporting mechanism can be employed such as a mechanical pulse generator. Likewise, the encoder can comprise an electronic encoder that delivers a continuous stream of even pulses for each constant increment of rotation by the agitator—wherein the controller counts each pulse as it is received and interprets the number and timing of pulses. It is contemplated mainly that the existing paddle movement reporting mechanism be adjusted to report an expected movement to the controller—notwithstanding the use of a larger toner supply -that normally alters a paddle's movement pattern beyond acceptable controller parameters. Accordingly, this description is meant to be taken only by way of example, and not to otherwise limit the scope of this invention.

What is claimed is:

1. An improved toner cartridge adapted to operate within a print engine having a controller interconnected with a motor of the print engine that requires a predetermined set of timing signals related to movement of an agitator paddle through a toner supply in a toner tank in a direction of rotation with respect to movement of a timing gear assembly operatively connected to the motor, the agitator paddle being spring-loaded in respect to the motor to allow the agitator paddle to move in a rotational range relative to the timing gear assembly upon application of resistance by toner in the toner supply, the agitator paddle operatively connected to a conventional encoder wheel, the conventional encoder wheel including a plurality of slots constructed and arranged to generate time-variable pulses as each of the slots passes through a sensor based upon spring-loaded rotation of the agitator paddle through the toner supply, wherein at a conventional maximum level of toner supply the agitator paddle passes through the toner and generates time-variable pulses within the required timing signal range for the controller, and at a level of toner supply greater than the conventional maximum level generates time-variable pulses outside the required timing signal range, thereby causing the controller to produce an error signal in the print engine, the improvement comprising:

an improved encoder wheel having a plurality of slots constructed and arranged to generate time-variable pulses that enable the cartridge to have an improved maximum level for the toner supply in the toner tank greater than the conventional maximum level by reproducing the required time signals with respect to the movement of the motor, wherein the signals at the improved maximum level substantially match the signals the controller requires for the conventional maximum level.

2. The cartridge as set forth in claim 1, wherein the toner tank defines a cylinder wherein the agitator paddle rotates about an axis substantially at a center of the cylinder and wherein the cartridge includes a developer section adjacent a side of the toner tank, the developer section receiving toner from the toner tank, and further comprising a tank extension space projecting outwardly from a side of the toner tank opposite a side of the toner tank adjacent the developer section, the tank extension space including toner therein.

3. The cartridge as set forth in claim 1 wherein the slots of the improved encoder wheel are located at an offset related to a difference between the conventional maximum level and the improved maximum level so that the slots pass through the sensor at a time with respect to rotation of the agitator paddle that provides time-variable pulses that correspond to the required set of timing signals.

4. The cartridge as set forth in claim 1, wherein the timing gear assembly comprises a driven gear having a stop and an outer drive member that moves within the rotational range with respect to the driven gear between a pair of end walls on the outer drive member that respectively engage the stop on the driven gear, wherein the stop is sized to limit the rotational range based upon the improved maximum level.

5. A method for adapting a toner cartridge to operate within a print engine having a controller interconnected with a motor of the print engine that requires a predetermined set of timing signals related to movement of an agitator paddle through a toner supply in a toner tank in a direction of rotation with respect to movement of a timing gear assembly operatively connected to the motor, the agitator paddle being spring-loaded in respect to the motor to allow the agitator paddle to move in a rotational range relative to the timing gear assembly upon application of resistance by toner in the toner supply, the agitator paddle operatively connected to a conventional encoder wheel, the conventional encoder wheel including a plurality of slots constructed and arranged to generate time-variable pulses as each of the slots passes through a sensor based upon spring-loaded rotation of the agitator paddle through the toner supply, wherein at a conventional maximum level of toner supply the agitator paddle passes through the toner and generates time-variable pulses within the required timing signal range for the controller, and at a level of toner supply greater than the conventional maximum level generates time-variable pulses outside the required timing signal range, thereby causing the controller to produce an error signal in the print engine, the method comprising:

providing an improved encoder wheel having a plurality of slots; and positioning the slots of the improved encoder wheel so as to generate time-variable pulses that enable the cartridge to have an improved maximum level for the toner supply in the toner tank greater than the conventional maximum level by reproducing the required time signals with respect to the movement of the motor, wherein the signals at the improved maximum level substantially match the signals the controller requires for the conventional maximum level.

6. The method as set forth in claim 5 wherein the step of positioning includes locating the slots of the improved encoder wheel at an offset related to a difference between the conventional maximum level and the improved maximum level so that the slots pass through the sensor at a time with respect to rotation of the agitator paddle that provides time-variable pulses that correspond to the required set of timing signals.

* * * * *